US009131565B2

(12) United States Patent
Hariharan

(10) Patent No.: US 9,131,565 B2
(45) Date of Patent: Sep. 8, 2015

(54) LED LIGHTING SYSTEM AND METHOD

(71) Applicant: Maxim Integrated Products, Inc., San Jose, CA (US)

(72) Inventor: Suresh Hariharan, Livermore, CA (US)

(73) Assignee: Maxim Integrated Products, Inc., San Jose, CA (US)

( * ) Notice: Subject to any disclaimer, the term of this patent is extended or adjusted under 35 U.S.C. 154(b) by 10 days.

(21) Appl. No.: 13/863,285

(22) Filed: Apr. 15, 2013

(65) Prior Publication Data

US 2014/0139107 A1 May 22, 2014

Related U.S. Application Data

(60) Provisional application No. 61/728,217, filed on Nov. 19, 2012.

(51) Int. Cl.
*H05B 39/04* (2006.01)
*H05B 33/08* (2006.01)

(52) U.S. Cl.
CPC ..... *H05B 33/0815* (2013.01); *Y10T 307/826* (2015.04)

(58) Field of Classification Search
CPC ..... H05B 37/02; H05B 3/00; H05B 33/08; H05B 33/02; H05B 4/36; B23K 9/10; F21S 4/001; F21S 4/00
USPC ..... 315/291, 141, 185 R, 209 R, 224, 246, 315/276, 307
See application file for complete search history.

(56) References Cited

U.S. PATENT DOCUMENTS

2012/0212134 A1* 8/2012 Hariharan ..... 315/85
2012/0229041 A1* 9/2012 Saes et al. ..... 315/200 R
2012/0268030 A1* 10/2012 Riesebosch ..... 315/276

* cited by examiner

*Primary Examiner* — Minh D A
(74) *Attorney, Agent, or Firm* — North Weber & Baugh LLP

(57) ABSTRACT

Various embodiments of the invention allow LED lamp fixtures to pass EMI testing irrespective of whether the lamp fixture is operated by a magnetic transformer or an electric transformer without causing input current waveform distortion and without defeating transformer compatibility. In certain embodiments, the type of transformer is determined based on detecting characteristic voltage waveforms and based that determination an EMI filter is automatically switched in and out of the lamp circuit.

16 Claims, 9 Drawing Sheets

600

700

800

LED LIGHTING SYSTEM AND METHOD

CROSS REFERENCE TO RELATED PATENT APPLICATIONS

The present application claims priority to U.S. Provisional Application Ser. No. 61/728,217 titled "LED Lighting System and Method," filed on Nov. 19, 2012 by Suresh Hariharan, which application is incorporated herein by reference in its entirety.

BACKGROUND

A. Technical Field

The present invention relates to solid-state lighting systems and, more particularly, to systems, devices, and methods of eliminating electromagnetic interference (EMI) in LED lamps and enabling operation with both magnetic and electronic transformers.

B. Background of the Invention

In a variety of lighting applications, environmentally friendly and efficient Light Emitting Diode (LED) lamps with long lifetimes unmatched by incandescent or fluorescent lamps are rapidly replacing conventional lamps. The MR16 halogen lamp, for example, which utilizes inefficient filament heating when generating light has been around since the 1960's, and was designed to run at three different power levels 20 W, 25 W, and 50 W. Today, most halogen-based lamps are powered by high power electronic transformers that are incompatible with LED lamps that are rated for considerably lower input power levels. This makes retrofitting halogen lamp fixtures with LED lamps an ongoing challenge.

Some lighting system designs allow LED lamps to operate with both magnetic and electronic transformers. However, operating an LED lamp with a magnetic transformer necessitates an electromagnetic interference (EMI) filter in order to pass various national and international EMI tests. Testing is performed according to standards that are generally imposed by governmental requirements, such as FCC Class B in the United States or EN55015 in Europe. Unfortunately, adding filtering negates the achieved compatibility between the LED lamp and the electronic transformer.

Possible solutions to avoid EMI issues include replacing electronic transformers with magnetic transformers that power EMI-filtered LED lamps, or replacing electronic transformers with LED-compatible ones. However, since most transformers are built into the lighting fixture, a consumer who wishes to retrofit a pre-existing lighting fixture is faced with limited access to limited access points, such as a few pins. Therefore, such solutions require the help of qualified technicians or electricians familiar with local and national electrical codes regarding installation, which increases the cost of the overall lighting system and is, therefore, rather impracticable for the retrofit market.

What is needed are systems and methods that overcome the above described limitations and allow LED lamps to be retrofitted with both magnetic and electronic transformers in a manner that allows to pass EMI testing.

SUMMARY OF THE INVENTION

Various embodiments of the invention permit lamp fixtures containing LEDs to pass EMI testing irrespective of whether the lamp fixture is operated by a magnetic transformer or an electric transformer.

In certain embodiments of the invention, this is accomplished by automatically switching an EMI filter into the lamp circuit when the LEDs are operated with a magnetic transformer and disconnected from the circuit when the LEDs are powered by an electronic transformer based on a determination regarding the type of transformer that powers the circuit.

In some embodiments, the determination is made by a switch network that detects a voltage waveform that is characteristic for the type of transformer and responds accordingly to selectively activate an EMI filter via a switch. The switch network comprises a set of open collector comparators that operate the switch.

BRIEF DESCRIPTION OF THE DRAWINGS

Reference will be made to embodiments of the invention, examples of which may be illustrated in the accompanying figures. These figures are intended to be illustrative, not limiting. Although the invention is generally described in the context of these embodiments, it should be understood that it is not intended to limit the scope of the invention to these particular embodiments.

DETAILED DESCRIPTION OF THE PREFERRED EMBODIMENTS

In the following description, for the purpose of explanation, specific details are set forth in order to provide an understanding of the invention. It will be apparent, however, to one skilled in the art that the invention can be practiced without these details. One skilled in the art will recognize that embodiments of the present invention, described below, may be performed in a variety of ways and using a variety of means. Those skilled in the art will also recognize that additional modifications, applications, and embodiments are within the scope thereof, as are additional fields in which the invention may provide utility. Accordingly, the embodiments described below are illustrative of specific embodiments of the invention and are meant to avoid obscuring the invention.

Reference in the specification to "one embodiment" or "an embodiment" means that a particular feature, structure, characteristic, or function described in connection with the embodiment is included in at least one embodiment of the invention. The appearance of the phrase "in one embodiment," "in an embodiment," or the like in various places in the specification are not necessarily referring to the same embodiment.

Furthermore, connections between components or between method steps in the figures are not restricted to connections that are affected directly. Instead, connections illustrated in the figures between components or method steps may be modified or otherwise changed through the addition thereto of intermediary components or method steps, without departing from the teachings of the present invention.

Figures 1A, 1B, 1C:
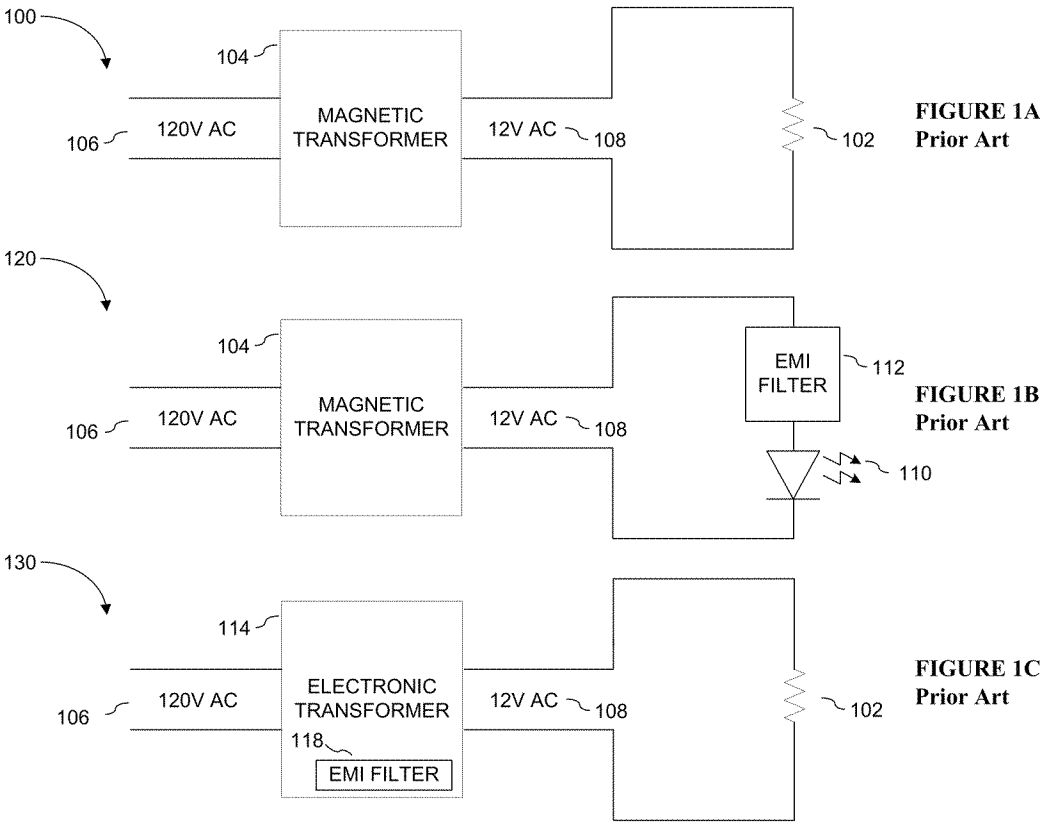
FIGURE 1A Prior Art
FIGURE 1B Prior Art
FIGURE 1C Prior Art
FIG. 1A illustrates a prior art lighting system that energizes a halogen lamp.
FIG. 1B illustrates a prior art lighting system that energizes an LED lamp.
FIG. 1C illustrates a prior art lighting system that comprises an electronic transformer that powers a halogen lamp.

In this document the terms "EMI" and "conducted EMI" are used interchangeably. Both terms include any non-radiation type electromagnetic interference recognized by one of skilled in the art. FIG. 1A illustrates a prior art lighting system 100 that energizes a halogen lamp to generate light. Halogen lamp 102 is represented by a purely resistive load as it comprises no active elements. Typically, the resistance of halogen lamp 102 is nonlinear and exhibits a negative temperature coefficient. The resistance of halogen lamp 102 decreases with temperature, which increases the flow of current with increasing temperature. Since halogen lamps (e.g., MR16) generally require only a relatively low supply voltage AC, for example, 12 V AC compared to the voltage provided by an AC mains line, which nominally operates at 120 V AC and 50 Hz in the US and at 230 V AC and 60 Hz in Europe, typically, a transformer is used to downconvert the AC mains voltage to a lower AC voltage.

In applications in which the lower voltage AC is derived from magnetic transformer 104, as shown in FIG. 1A, halogen lamp 102 will have no difficulties in passing EMI testing. Certain tests are aimed mainly at preventing switching circuit components from causing conducted EMI that affects the voltage in the utility line, which delivers AC mains voltage 106. It is noted that EMI is different from radiation-related interference issues, such as RFI, which are easier to solve, for example, by following good engineering practices and proper circuit design focusing on layout and placement of potentially radiating circuit elements, including electrical wires.

Here, since no high frequency switching circuit elements are involved in either halogen lamp 102 or magnetic transformer 104, EMI issues are not expected to cause any undesired effects to AC mains voltage 106. Magnetic transformer 104, like halogen lamp 102, is a passive device. In the simplest case, transformer 104 comprises primary and secondary windings that are magnetically coupled, preferably via some ferromagnetic material, such as iron, to convert AC mains voltage 106. Magnetic transformer 104 contains no high frequency switching elements or any circuit components that generate high frequency components capable of causing EMI issues.

In FIG. 1B the halogen lamp is replaced with LED lamp 110 (e.g., an LED MR16 lamp). LED lamp 110 is typically an array of sorts and comprises an LED driving circuit that includes active circuit elements that are electrically connected within a high frequency switching circuit. The switching circuit, in particular, is likely to cause EMI that will be present on AC mains line 106 and likely result in LED lamp 110 not passing the same or similar EMI testing as the halogen lamp in FIG. 1A. One approach is to add EMI filtering 112 to lighting system 120, as shown in FIG. 1B. Filtering may be added, for example, directly to a lamp assembly that includes LED lamp 110. Note that the output voltage of magnetic transformer 104 is typically a 50 Hz or 60 Hz frequency AC voltage with an RMS value in the range from 9 $V_{RMS}$ to 13.2 $V_{RMS}$. This is true also in lighting systems in which the transformer is an electronic transformer, which is the case in the majority of applications.

FIG. 1C illustrates a prior art lighting system 130 that comprises an electronic transformer that powers a halogen lamp. Electronic transformers comprise a high frequency switching circuitry that allows designers to significantly reduce the size of a transformer compared to its relatively bulky and heavy magnetic counterpart. Electronic transformer 114 operates similar to the magnetic transformer in FIG. 1A in that it downconverts AC mains voltage 106 to a lower AC voltage 108 to drive halogen lamp 102. Electronic transformer 114 accomplishes downconversion by using an internal switching circuit that performs switching functions to create a rectified high-frequency voltage that pulsates typically in the range of 20 kHz to 100 kHz with a low frequency (e.g., 50 Hz) waveform envelope. As long as the load is a purely resistive element, as in the case of halogen lamp 102, the RMS value of AC voltage 108 will remain 12 $V_{RMS}$. The minimum switching frequency is preferably chosen to be above 20 kHz in order to prevent any unintentionally generated audible noise. This high frequency switching component will be present not only in the AC voltage output of electronic transformer 114, but also at the input of halogen lamp 102. Thus, when halogen lamp 102 is tested for EMI, it will not pass EMI testing, unless electronic transformer 114 has a properly working EMI filter 112. EMI filter 112 is, for example, a built-in Pi-filter located at the input of electronic transformer 114.

Figure 2:
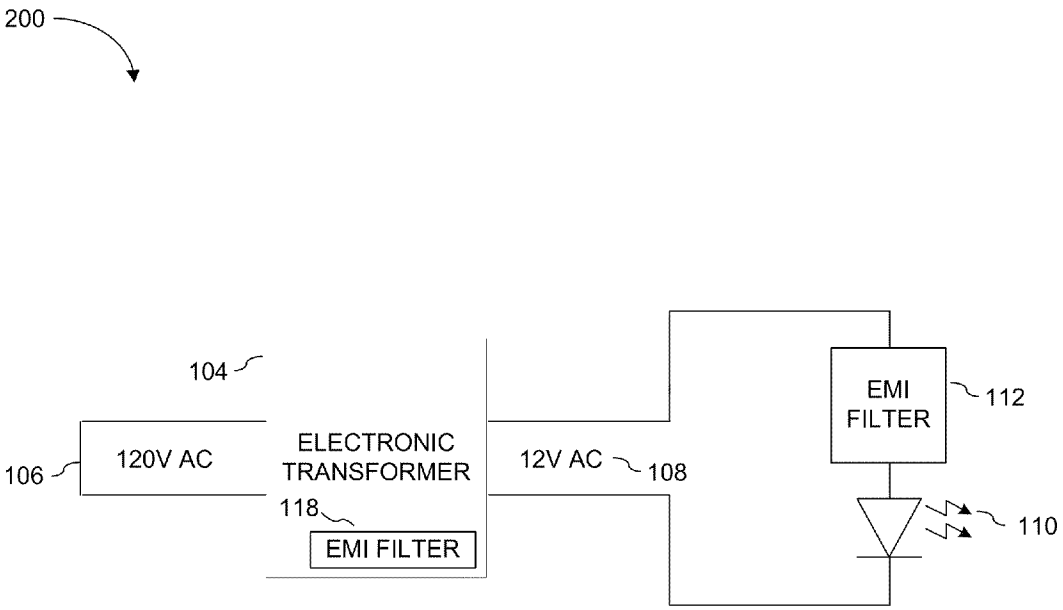
FIGURE 2 Prior Art
FIG. 2 illustrates a hypothetical lighting system that comprises an electronic transformer that powers an LED lamp that has a built-in EMI filter.

FIG. 2 illustrates a hypothetical lighting system that comprises an electronic transformer that powers an LED lamp that has a built-in EMI filter. This configuration is encountered when consumers try to retrofit existing halogen lamp fixtures, for example, ones comprising MR16-type halogen lamps, with modern MR16-type LED lamps, which is problematic for two major reasons. First, most electronic transformers 104 are self-oscillating devices and, thus, do not contain control circuitry. If the load resistance is relatively high, electronic transformer 104 will not function because the high frequency switching action is based on the premise that, at all times, the primary winding of electronic transformer 104 draws sufficient gate current to sustain a high frequency oscillation. In other words, to properly function, electronic transformer 104 expects to connect to a load that is within the rage that electronic transformer 104 was originally designed to operate at.

For example, electronic transformers for halogen lamps are designed to operate 20 W, 25 W, and 50 W halogen bulbs and, thus, draw a relatively high current that is in the 2.2 A to 5.5 A range. However, LED lamp 110 by its design draws relatively little current when compared to the halogen lamp in FIG. 1C. Assuming electronic transformer 104 is designed to operate a 35 W halogen lamp, and further assuming LED lamp 110 is a 7 W lamp with a purely resistive load providing the equivalent luminescence of a 35 W halogen lamp, the current in LED lamp 110 will be approximately five times lower than the expected current value electronic transformer 104 was designed for. If the current drops below the minimum value that this particular transformer design requires to properly operate, the oscillation in electronic transformer 104 will cease and will not resume on its own. Consequently, electronic transformer 104 will fail to switch and not provide the proper voltage to drive LED lamp 110. Some existing designs successfully solve the incompatibility problem between electronic transformer 104 and LED lamp 110. (See U.S. patent application Ser. No. 13/290,411, titled "Electronic Transformer Compatibility for Light Emitting Diode Systems," filed by Applicant on Nov. 7, 2011).

However, even if this issue can be resolved, a second issue remains: Lighting system 200 will fail EMI testing. EMI filter 112 that enables LED lamp 110 to pass EMI testing when driven by a magnetic transformer, as was the case in FIG. 1B, cannot be used when LED lamp 110 is driven by electronic transformer 114, in the configuration shown in FIG. 2, because the capacitors in EMI filter 112 would draw current diverting it from the input of LED driver circuit (not shown). This phenomenon will cause a distortion in the input current waveform and, ultimately, will cause a failure in the operation of LED lamp 110 and defeat transformer compatibility.

Therefore, it would be desirable to be able to use a single lighting system that can pass EMI testing not only when LED lamp 110 with its built-in EMI filter 112 is connected to a magnetic transformer, as shown in FIG. 1B, but also when LED lamp 110 is connected to an electronic transformer, as shown in FIG. 2.

Figure 3:
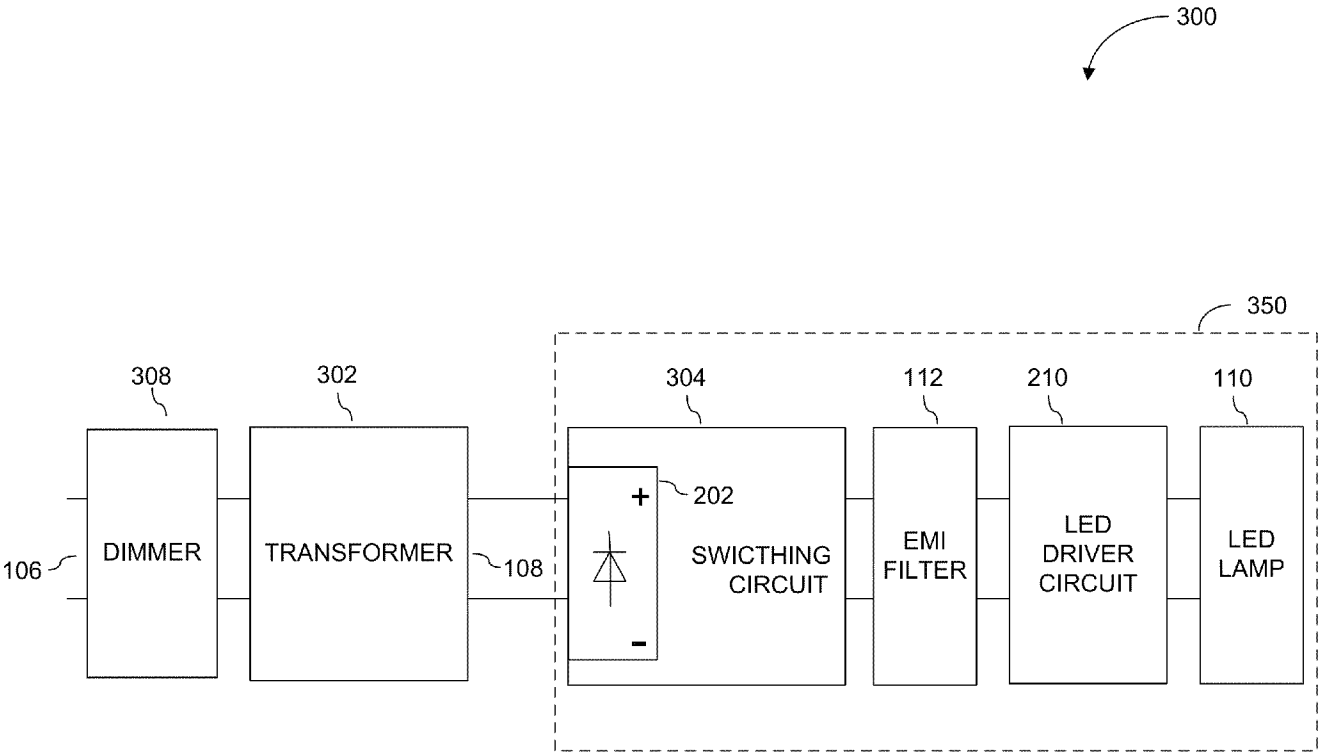
FIG. 3 illustrates a simplified exemplary block diagram of a lighting system according to various embodiments of the invention.

FIG. 3 illustrates a simplified block diagram of a lighting system according to various embodiments of the invention. Lighting system 300 comprises transformer 302, which may be an electronic or a magnetic transformer that receives AC mains voltage 106 and outputs a relatively lower AC voltage 108. Transformer 302 is coupled to switching circuit 304 that receives the downconverted AC voltage 108. Switching circuit 304 impresses AC voltage 108 on LED driver circuit 210 and, depending on whether transformer 302 is an electronic or a magnetic transformer, connects EMI filter 112 into the circuit. LED driver circuit 210 drives LED lamp 110, which by electronic excitation of semiconductor material efficiently converts energy into visible light, or any other LED known in the art. LED lamp 110 may be an array of LEDs coupled to each other in any suitable configuration.

In one embodiment, switching circuit 304, EMI filter 112, LED driver circuit 210, and LED lamp 110, may be integrated into one LED lighting assembly 350. EMI filter 112 is any EMI filter design known in the art that can reduce high frequency noise, such as the "Pi-filter" presented in FIG. 2. EMI filter 112 is configured to couple to switching circuit 304 and LED driver circuit 210, and may be a standalone unit, as shown in FIG. 3. Bridge rectifier 202 comprises a diode bridge that converts output AC voltage 108 to a rectified positive voltage that operates LED driver circuit 210, which provides a pulse width modulated or amplitude modulated current to LED lamp 110. Bridge rectifier 202 may be integrated within switching circuit 304. Lighting system 300 may optionally comprise dimmer 308 to dynamically change the luminescence of LED lamp 110 via LED driver 310 current. In some embodiments, it may be advantageous to place dimmer 308 at the output of LED driver circuit 310.

Switching circuit 304 may engage EMI filter 112 depending on whether transformer 302 is an electronic or a magnetic transformer, as previously described. In one embodiment, switching circuit 304 comprises circuit elements that are configured to identify whether transformer 302, which is configured to couple to LED lighting assembly 350, is a magnetic or an electronic transformer. Based on that information switching circuit 304 connects or disconnects EMI filter 112 from LED lighting assembly 350. The appropriate use of EMI filter 112 allows LED lighting assembly 350 to pass EMI testing when operated by either a magnetic or an electric transformer. When transformer 302 is a magnetic transformer, resembling the lighting system in FIG. 1B, EMI filter 112 enables LED lamp 110 to pass EMI testing; and when transformer 302 is an electronic transformer that is incompatible with EMI filter 112, resembling the lighting system in FIG. 1C, an EMI filter (not shown) coupled to transformer 302 allows LED lamp 110 to pass EMI testing.

In one embodiment, a switch (not shown) within switching circuit 304 may be coupled to EMI filter 112 and operated in a manner that when switching circuit 304 receives a voltage waveform characteristic of a voltage generated by an electronic transformer, the switch turns off, to disable EMI filter 112. In contrast, when switching circuit 304 receives a voltage waveform characteristic of a voltage generated by a magnetic transformer, the switch turns on, such that EMI filter 112 is operative within lighting system 300. The invention is not limited to detecting characteristic voltages. One skilled in the art will appreciate that the switch may respond to a current, a waveform, or a combination of characteristics of transformer 302. Waveforms can be identified, for example, with a voltage current sense, by comparing waveforms with a comparator, or any other method of detection in order to obtain information about transformer 302 on which to base the decision whether to activate EMI filter 112. In one embodiment, switching circuit 304 automatically disables EMI filter 112 by disconnecting one or more capacitors of EMI filter 112 from LED lighting assembly 350, while one or more inductors of EMI filter 112 remain connected to the circuit.

In one embodiment, as soon as transformer 302 is detected or identified as a magnetic transformer, a latch circuit is engaged, for example, via a switch within switching circuit 304 to automatically latch EMI filter 112 and provide continuous filtering.

Figure 4:
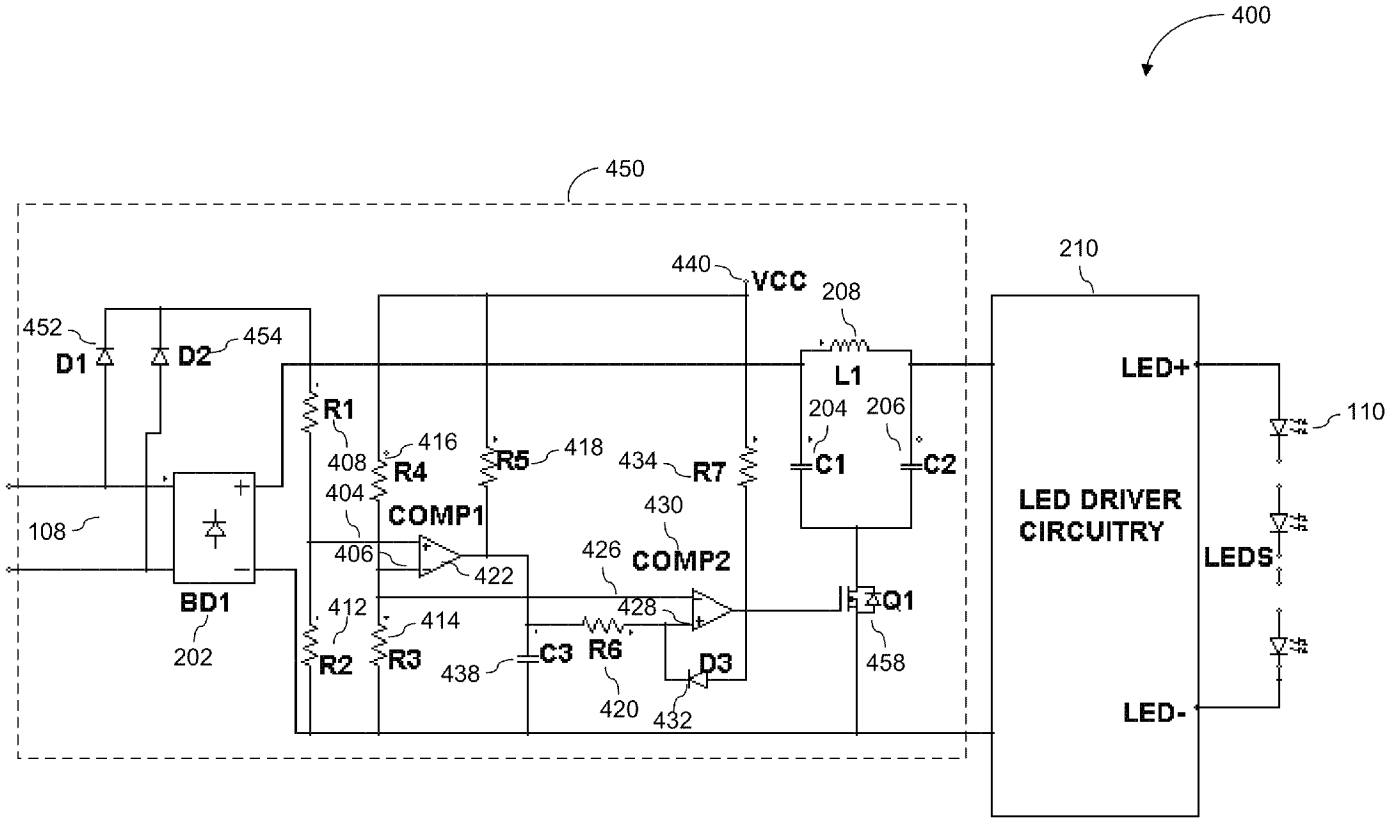
FIG. 4 illustrates an exemplary implementation of the lighting system in FIG. 3, according to various embodiments of the invention.

FIG. 4 illustrates an exemplary implementation of the lighting system in FIG. 3, according to various embodiments of the invention. For simplicity and clarity, the transformer and the optional dimmer are omitted from FIG. 4. LED lighting system 400 comprises switching circuit 450 that is coupled to LED driver circuit 210 that generates a regulated current to operate LED lamp 110 with an appropriate amount of power. In one embodiment, EMI filter 112 and bridge rectifier 202 are integrated into switching circuit 450. Bridge rectifier 202 comprises a diode bridge to convert AC input voltage 108 (e.g., 12 V) to a rectified voltage that operates the LED driver circuitry. Switching circuit 450 further comprises EMI filter components 204-208, comparators 420, 430, switch 458, diodes 452, 454, 432, capacitor 438, and various resistors 408-420. LED lighting system 400 may be implemented, for example, in an LED lamp assembly. Next, the operation of switching circuit 450 is discussed in detail.

In one embodiment, supply voltage $V_{CC}$ 440 is a regulated DC voltage that is derived from within LED driver circuitry 210. Via divider action, DC supply voltage 440 generates a constant reference voltage across resistor R3 414. This constant voltage is applied to negative inputs 406, 426 of comparators COMP1 422 and COMP2 430, respectively. Diodes D1 452 and D2 454 are added to switching circuit 450 to create a rectified voltage that appears on the cathodes of diodes D1 452 and D2 454. In one embodiment, if an electronic transformer is used to power LED lamp 110, a pulsating DC voltage will appear on the cathodes of D1 452 and D2 454. COMP1 422 is an open collector comparator comprising, for example, a transistor or a MOSFET device (not shown). This transistor turns off when positive input 404 of COMP1 422 is higher than negative input 406. Once the transistor within COMP1 422 turns off, capacitor C3 438 will charge up through the current flowing in resistor R5 418. If at any time the voltage at negative input 406 of COMP1 422 exceeds the voltage at positive input 404 of COMP1 422, the transistor within COMP1 422 will be turned on, and capacitor C3 438 will quickly discharge toward zero Volt.

In one embodiment, the resistance value of resistor R5 418 and the capacitance value of capacitor C3 438 are chosen such that the voltage across C3 438 will exceed the voltage on negative input 426 of COMP2 430 only if the voltage on positive input 404 to COMP1 422 exceeds the voltage on its negative input 406 for a period of time greater than, for example, 100 μsec. Given the relatively short time constant of a switched electronic transformer, this scenario can happen only when AC input voltage 108 is derived from a magnetic transformer, which exhibits a relatively much longer time constant.

When the voltage at positive input 428 of COMP2 430 does exceed the voltage at negative input 426, the output of COMP2 430 goes high, i.e., it flips state. COMP2 430 may have an open collector output or a totem pole output. COMP1 422 should have an open collector output. Once the output of COMP2 430 goes high, it latches the output of COMP2 430 permanently high and stays high. This output now drives transistor Q1 458, for example an external MOSFET. As a result, capacitors C1 204 and C2 206 will be will connected into the circuit to provide EMI filtering.

If AC input voltage 108 is derived from an electronic transformer, the voltage at positive input 428 of COMP2 430 will charge capacitor C3 438 for the duration of one pulse width, but then immediately discharges as soon as the voltage sags during the dead portion of the rectified waveform. Consequently, capacitor C3 438 will not have sufficient time to charge up to the required voltage to allow the voltage at positive input 428 of COMP2 430 to exceed the reference voltage at negative input 426 of COMP2 430. The output of COMP2 430 cannot go high to turn on transistor Q1 458, and capacitors C1 204 and C2 206 remain disconnected from the circuit. As a result, capacitors C1 204 and C2 206 are prevented from causing the electronic transformer to malfunction.

One advantage of this embodiment is that the use of a dimmer when dimming is required will have no effect on the operation of lighting system 400 since dimming causes only changes in current amplitude but not in the pulse width. One skilled in the art will appreciate that it is not necessary to disconnect both ends of each capacitor C1 204 and C2 206 from the circuit, and that it is sufficient to disconnect the one terminal of each capacitor that is connected to switch 458 in order to achieve the goal of operating an electronic transformer with LED lighting system 400. Note that capacitor R1 408 captures the true waveform at the input of switching circuit 450. This prevents misidentification of the type of transformer caused by, first, capacitor loading by capacitor 204, 206 that, as previously mentioned, destroys the input voltage waveform; second, by initial conditions in which capacitor 204, 206 is engaged or accidentally switched in.

In one embodiment, as soon as the transformer is identified as a magnetic transformer and switch 458 is turned on, the voltage at positive input 428 of COMP2 430 goes high and remains high since diode D3 432 operates as a latch circuit to latch the output of COMP2 430, such that filtering is permanently enabled.

FIGS. 5-8 show experimental data taken by an oscilloscope to demonstrate the benefits of an LED lighting system employing a switching circuit, according to various embodiment of the invention.

Figure 5:
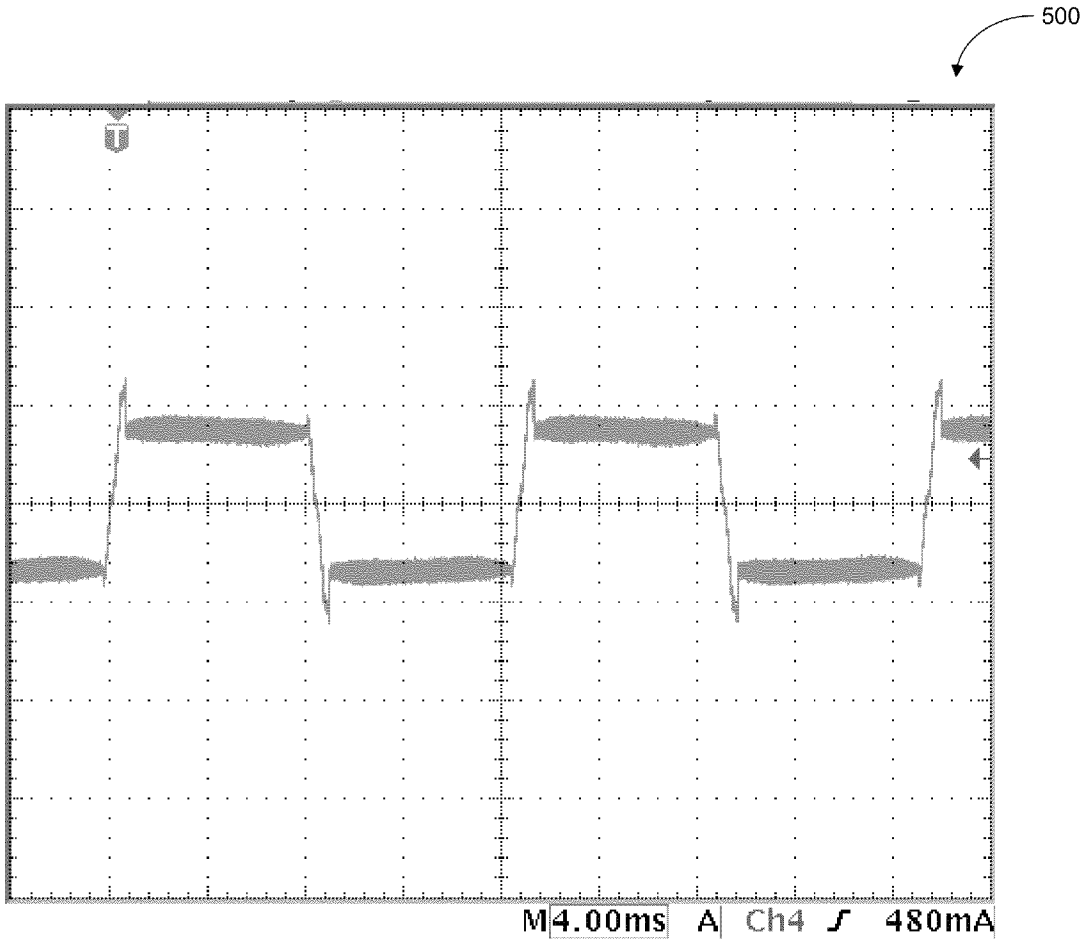
FIGURE 5 PRIOR ART
FIG. 5 shows current flow measured at the input to a prior art LED lighting system that is powered by a magnetic transformer without the use of a switching circuit or an EMI filter.

FIG. 5 shows current flow measured at the input to a prior art LED lighting system that is powered by a magnetic transformer without the use of a switching circuit or an EMI filter.

Figure 6:
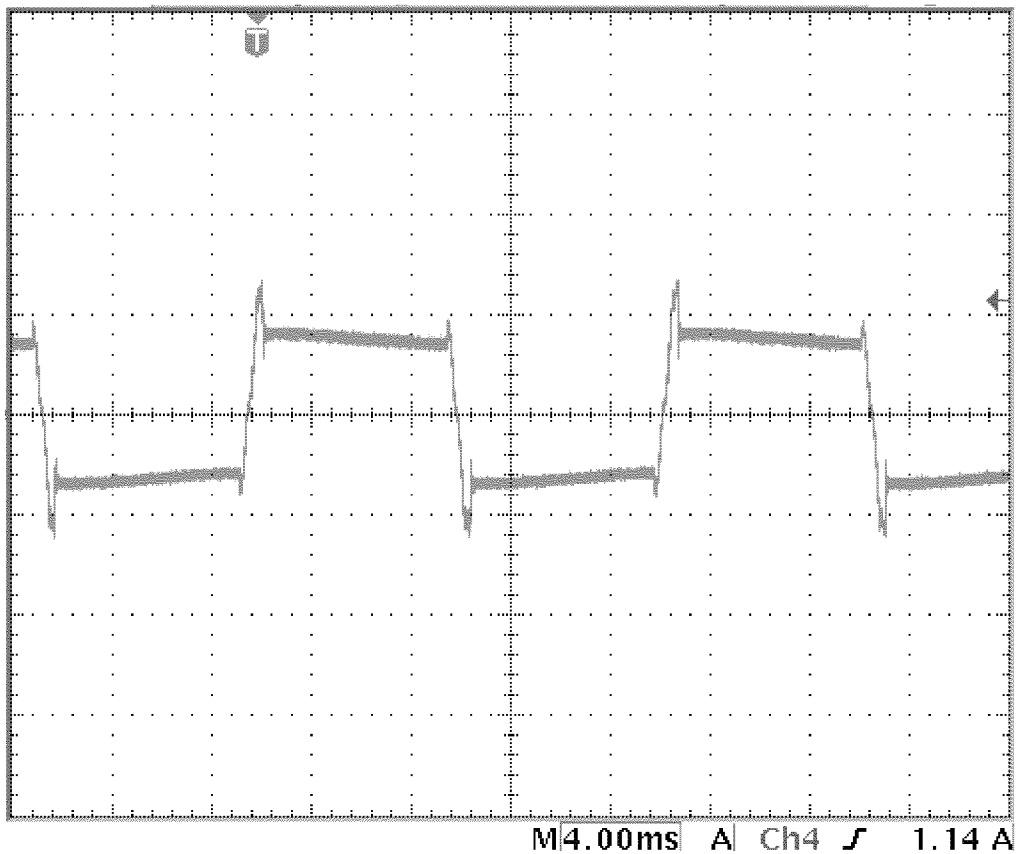
FIG. 6 shows current flow measured at the input to an LED lighting system that is powered by a magnetic transformer and uses a switching circuit, according to various embodiments of the invention.

FIG. 6 shows current flow measured at the input to an LED lighting system that is powered by a magnetic transformer and uses a switching circuit, according to various embodiments of the invention.

Figure 7:
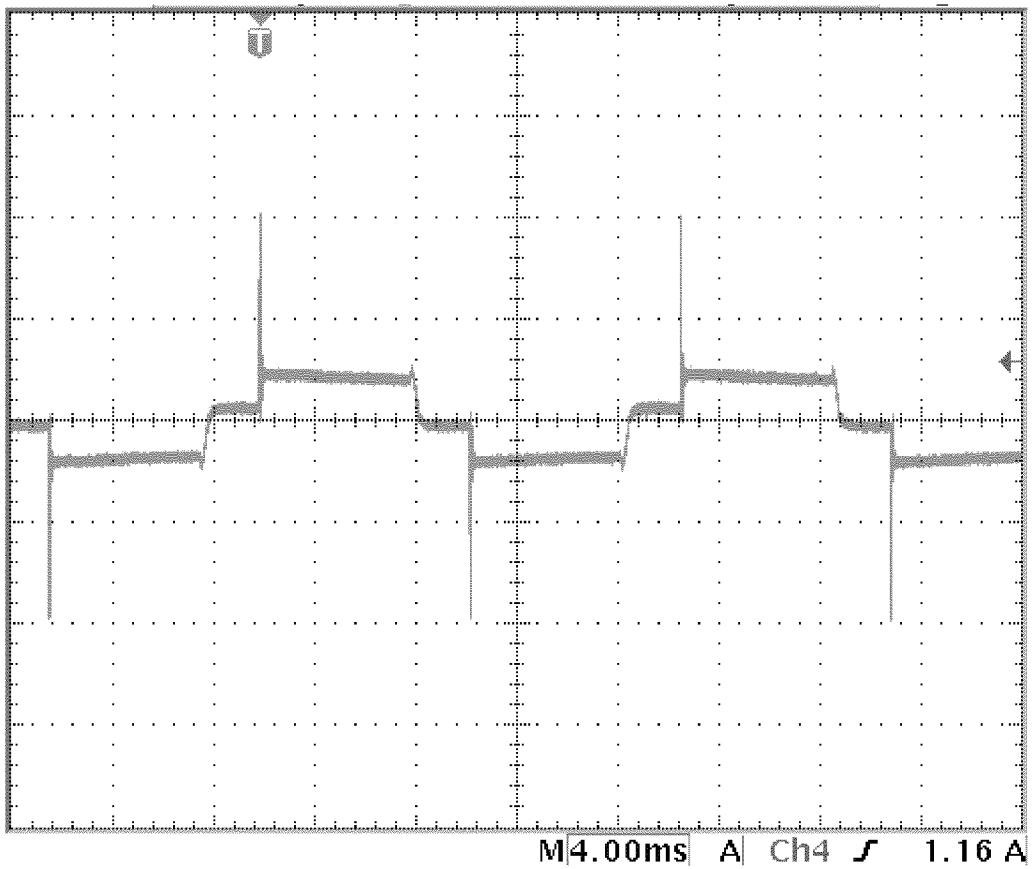
FIG. 7 shows current flow measured at the input to an LED lighting system that is powered by a magnetic transformer and uses a switching circuit and a dimmer, according to various embodiments of the invention.

FIG. 7 shows current flow measured at the input to an LED lighting system that is powered by a magnetic transformer and uses a switching circuit and a dimmer, according to various embodiments of the invention. In this example, the dimmer is implemented at the AC input to the magnetic transformer and is used to reduce the luminescence of level of light emitted by the LED lighting system.

Figure 8:
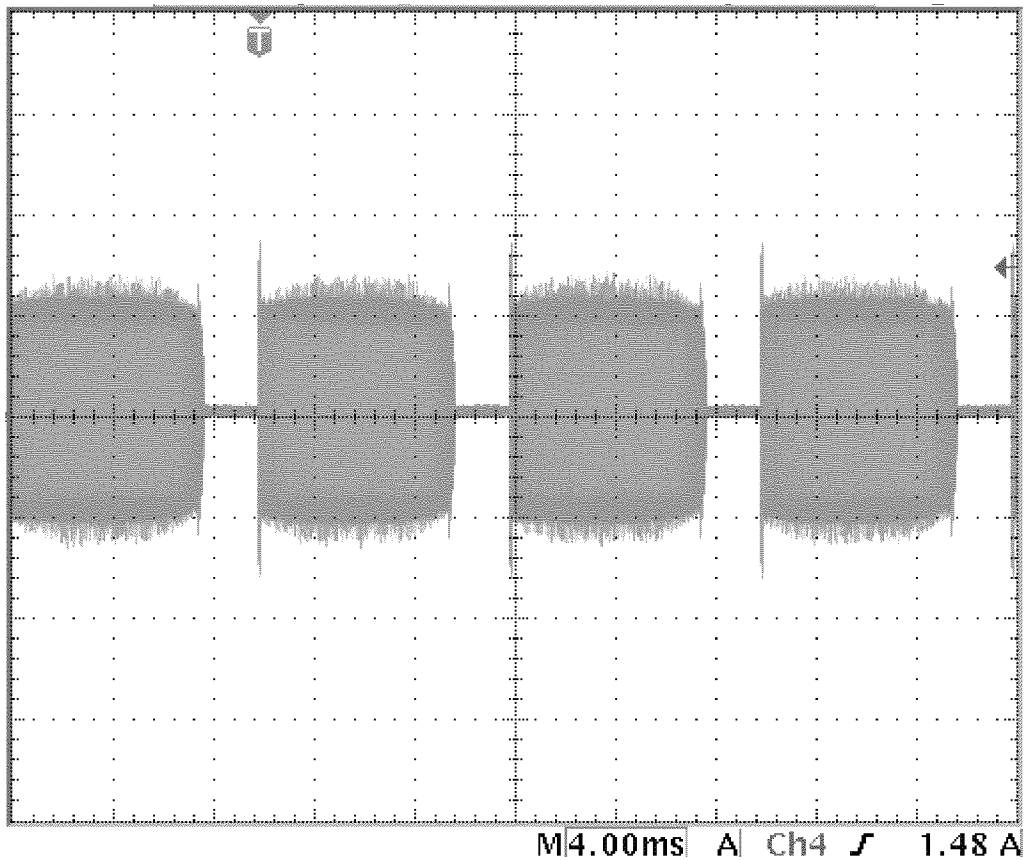
FIG. 8 shows current flow measured at the input to an LED lighting system that is powered by an electronic transformer and uses a switching circuit, according to various embodiments of the invention.

FIG. 8 shows current flow measured at the input to an LED lighting system that is powered by an electronic transformer and uses a switching circuit, according to various embodiments of the invention. The switching circuit comprises an EMI filter that is disconnected from the negative terminal of the diode bridge, thus, preventing filter capacitors within the EMI filter from affecting the operation of the LED lamp when it is powered by the electronic transformer. Note that the electronic transformer comprises its own internal EMI filter that enables the LED lighting system to pass EMI testing.

As FIGS. 5-8 demonstrate, the LED lighting system allows an LED lighting system to pass EMI testing when the LED lamp is operated with a magnetic transformer.

Figure 9:
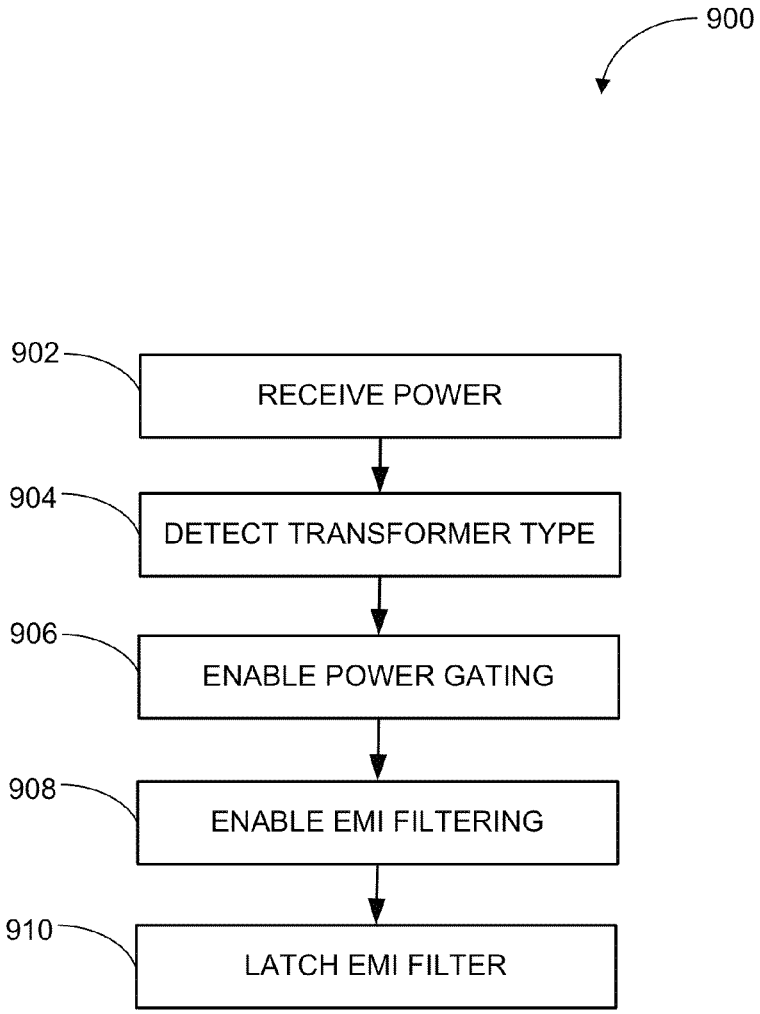
FIG. 9 is a flowchart of an illustrative process for automatically operating a load with either a magnetic or an electronic transformer, in accordance with various embodiments of the invention.

FIG. 9 is a flowchart of an illustrative process for automatically operating a load with either a magnetic or an electronic transformer, in accordance with various embodiments of the invention.

The process 900 for operating the load, which, in this example, is an LED lamp starts at step 902 when a switching circuit receives power from a power source. The switching circuit may comprise an EMI filter.

At step 904, the switching circuit detects whether the LED lamp is powered via a magnetic or an electronic transformer. Detection may be based on a comparison of voltage waveform characteristics, such as pulse widths.

At step 906, the switching circuit automatically enables EMI filtering when the LED lamp is operated with a magnetic transformer and to disable EMI filtering when the LED lamp is powered by an electronic transformer.

In response to detecting whether the transformer is a magnetic or an electronic transformer, at step 908, a latch circuit automatically latches an EMI filter.

It will be appreciated by those skilled in the art that fewer or additional steps may be incorporated with the steps illustrated herein without departing from the scope of the invention. No particular order is implied by the arrangement of blocks within the flowchart or the description herein.

It will be further appreciated that the preceding examples and embodiments are exemplary and are for the purposes of clarity and understanding and not limiting to the scope of the present invention. It is intended that all permutations, enhancements, equivalents, combinations, and improvements thereto that are apparent to those skilled in the art, upon a reading of the specification and a study of the drawings, are included within the scope of the present invention. It is therefore intended that the claims include all such modifications, permutations, and equivalents as fall within the true spirit and scope of the present invention.

What is claimed is:

1. A switching circuit to automatically identify a transformer, the circuit comprising:

a first comparator comprising a first input voltage and a second input voltage;

a second comparator coupled to the first comparator; and a switching network coupled between the second comparator and an EMI filter, the switching network comprises at least one switch and engages the EMI filter in response to the at least one switch being activated by the second comparator, wherein the at least one switch is activated in response to a first input voltage of the first comparator exceeding a predetermined threshold of a second input voltage of the first comparator.

2. The circuit according to claim 1, wherein the at least one switch is activated in response to the first input voltage of the first comparator exceeding for a predetermined time the predetermined threshold of the second input voltage of the first comparator.

3. The circuit according to claim 1, wherein the first comparator is an open collector comparator.

4. The circuit according to claim 1, wherein the EMI filter is configured as a Pi filter.

5. The circuit according to claim 1, further comprising a bridge rectifier that generates a rectified voltage to operate an LED driver circuit.

6. A method for automatically identifying a transformer, the method comprising:

receiving power from a power source by a switching circuit that comprises an EMI filter;

identifying the type of a transformer that is coupled to the switching circuit; and selectively activating an EMI filter in response to the identification, wherein identifying comprises detecting one or more transformer characteristics, wherein detecting one or more transformer characteristics comprises detecting one of a voltage waveform or current waveform.

7. The method according to claim 6, wherein activating the EMI filter comprises latching the EMI filter in response to the one or more transformer characteristics.

8. The method according to claim 6, wherein identifying comprises sensing a current.

9. A lighting system comprising:

an EMI filter;

a switching circuit comprising a switch, the switching circuit detects one or more characteristics of a transformer, wherein the one or more characteristics of the transformer comprise one of a voltage waveform or current waveform and decouples the EMI filter from the lighting system in response to determining that the transformer is with the EMI filter, wherein the switching circuit is configured to engage the EMI filter in response to detecting a magnetic transformer; and an LED driver circuit coupled to the switching circuit, the LED driver circuit operates an LED.

10. The lighting system according to claim 9, wherein the transformer is one of a magnetic and an electronic transformer.

11. The lighting system according to claim 9, wherein the switching circuit is configured to disengage the EMI filter in response to detecting that the transformer is an electronic transformer.

12. The lighting system according to claim 11, wherein the switch deactivates the EMI filter by disconnecting one or more capacitors of the EMI filter.

13. The lighting system according to claim 9, wherein the EMI filter is configured to operate as a standalone unit.

14. The lighting system according to claim 9, wherein the switching circuit detects the one or more characteristics of a transformer via a current sensor.

15. The lighting system according to claim 9, wherein the LED driver circuit is configured to generate one of a pulse width modulated and an amplitude modulated current.

16. The lighting system according to claim 9, further comprising a dimming circuit located at the output of the LED driver circuit, the dimming circuit is configured to dynamically change the luminescence of an LED.

* * * * *